United States Patent [19]

Hawkins

[11] 4,227,624

[45] Oct. 14, 1980

[54] PULL TAB CLOSURE

[75] Inventor: Jerry D. Hawkins, Country Club Hills, Ill.

[73] Assignee: The Continental Group, Inc., Stamford, Conn.

[21] Appl. No.: 40,331

[22] Filed: May 18, 1979

[51] Int. Cl.[3] ..... B65D 41/32

[52] U.S. Cl. ..... 220/265; 220/270; 220/359

[58] Field of Search ..... 220/260, 265, 270, 359; 222/541; 229/7 R

[56] References Cited

U.S. PATENT DOCUMENTS

| | | | |
|---|---|---|---|
| 3,985,261 | 10/1976 | Kulesa | 220/270 |
| 4,091,957 | 5/1978 | Moller | 220/270 X |
| 4,116,359 | 9/1978 | Josephy | 220/265 |

*Primary Examiner*—George T. Hall

*Attorney, Agent, or Firm*—John J. Kowalik; Joseph E. Kerwin; Charles E. Brown

[57] ABSTRACT

A tape made of a laminate of thermoplastic plastic material and metal having a finger ring portion in which the edge of the hole is hemmed by folding the plastic portion upon itself and heat sealed to each other.

7 Claims, 4 Drawing Figures

PULL TAB CLOSURE

This invention is directed to tape seals for pour openings of containers of the type shown and discussed in U.S. Pat. Nos. 3,990,615 and 4,116,359. In such structures, a tape strip made of a laminate of a thermoplastic and dead soft aluminum is used. The aluminum is of minimum tensile strength and the laminate is very thin. The tape comprises a rectangular body portion which is attached at one end to the end panel of a can by a permanent bond and in the area of the pour opening is attached by a peelable bond. A finger ring is provided at the free end of the tape and in prior practice the ring hole has been hemmed by folding an edge portion of the tape about finger hole with the hem metal portion or the tape overlaid directly over the metal portion of the ring. In many instances, where the peelable bond was strong or if any cracks developed in the metal in the hem about the ring hole, the user, in pulling on the tape to open the container, would break the ring portion thereby making it difficult to open the can because of lack of purchase on the broken ring which would, if pulled by the unbroken part, then entirely break off.

SUMMARY OF THE INVENTION

This invention is directed to a novel construction of the pull ring of a tape seal for the pour opening of a high-pressure container for pressurized beverages.

A more specific object of the invention is to provide a laminated tape having a weak metal component and a plastic component bonded thereto wherein a pull ring is provided at one end and the margin of the finger opening in the ring is hemmed in such manner that a plastic or plastic overlap is obtained and the same are bonded to each other to provide strong structural integrity so that the ring will not break apart.

These and other objects and advantage inherent in and encompassed by the invention will become more apparent from the specification and drawings, wherein.

DESCRIPTION OF THE INVENTION

The invention is embodied in a can end 2 which has a pour opening 3 which is covered by a tape seal strip 4, which is a laminate composed of a dead soft aluminum foil 5 and a thin layer of thermoplastic material such as polypropylene.

Figure 1:
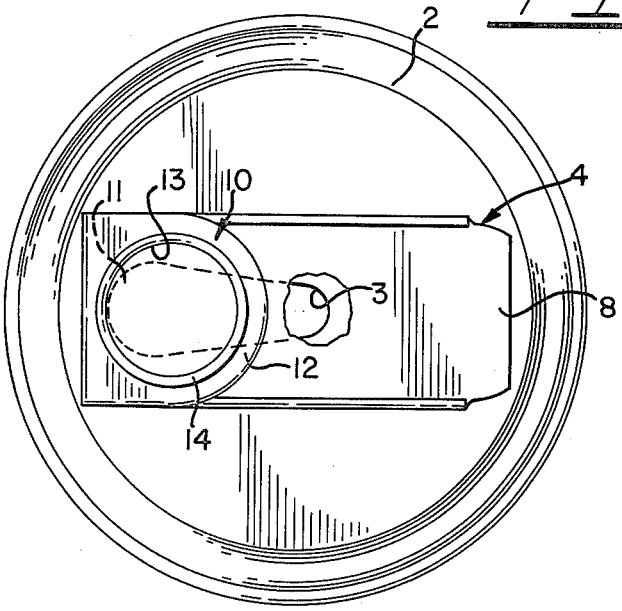
FIG. 1 is a top plan view of a can end incorporating the invention.
Figure 2:
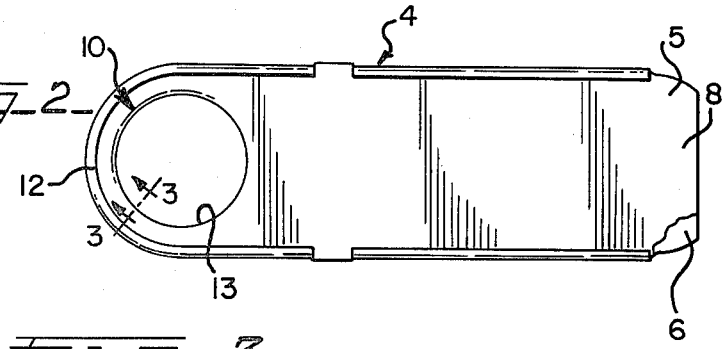
FIG. 2 is a top plan view of the sealing tape.

As best seen in FIG. 2, the strip is a rectangular structure having a body portion of which overlies the pour opening 11 and is secured to the can top by a peelable adhesive of the type described in U.S. Pat. No. 3,990,615. The end 8 of the tape is secured by a permanent bonding adhesive such as disclosed in U.S. Pat. No. 4,029,033. A grasp or lift end portion 10 is provided on the tab which is normally folded over the body portion

7 of the tab. The lift portion 10 has a ring 12 which has a finger hold 13 with a hemmed edge portion 14.

Figure 4:
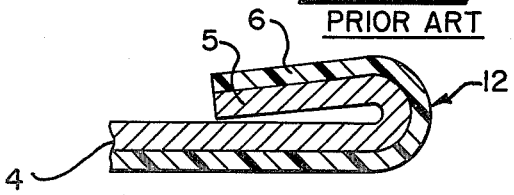
FIG. 4 PRIOR ART
FIG. 4 is a cross-sectional view similar to FIG. 3 showing the prior art.

The hemming which has been done before in the prior art as seen in FIG. 4, has folded the porton 14 in a manner bringing the metal part 15 over the metal portion 5 thus merely doubling the structure about the hole 13. Although this hemming strengthened the ring, it does not develope a structure that will not break apart as has frequently occurred in the prior art.

Figure 3:
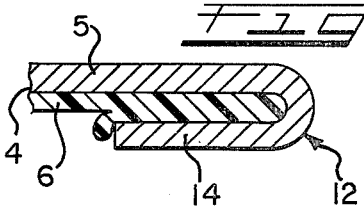
FIG. 3 is an enlarged cross-sectional view thereof taken substantially on line 3—3 of FIG. 2.

I have found that the structure would be greatly improved by hemming in the reverse way, that is, by folding the portion 14 under the ring and thus bringing the hem plastic into contact with the plastic laminate beneath the ring as seen in FIG. 3 and thereafter heating and pressing the same together so that they are bonded together or melted together into an integral structure. Thus, when the ring is pulled, the load is transmitted directly to both the metal as well as the plastic laminate. The plastic is approximately doubled in thickness and integral about the finger hole thus adding to its strength. Also, since the hem extends outwardly and can be compressed thin by squeezing out the plastic, the ring is made thin and does not interfere with folding the ring over the body for touch welding the ring to the body as disclosed in U.S. Pat. No. 3,985,261.

I claim:

1. A pull-tab comprising one elongated laminate member made of metal foil and thermoplastic film and having a body and a grasp section at one end of the body, said grasp section comprising a ring portion with a finger opening therein, a hem about the finger hole having a flange portion bent against the ring portion with the plastic film on the flange portion and the ring portion facing each other, and a heat bond between said portions forming an integral structure.

2. The invention according to claim 1, wherein the metal foil forms the edging about the opening.

3. The invention according to claim 1 and said metal foil being dead soft aluminum.

4. The invention according to claim 1 and said thermoplastic being polypropylene.

5. The invention according to claim 1 and said metal foil forming the edging about the opening and said metal foil being dead soft aluminum.

6. The invention according to claim 1 and said metal foil being dead soft aluminum and said thermoplastic film being polypropylene.

7. A pull-tab of the type adapted to be adhesively adhered to a container wall over a pour opening therein comprising;

a flat laminate strip having a reverse side comprising a thermoplastic film and an obverse side comprising a tearable metal foil;

said tab having a body part and a pull ring part adapted to be folded over said body part;

said pull ring having a finger hole therein, a hem about said hole folded over said ring part with the plastic film on the hem overlapping the plastic film on the ring part, and means permanently bonding said film on the hem with the film on the ring part, said film being squeezed out between the hem and ring part to reduce the thickness of said film therebetween in the overlap.

* * * * *